US008080784B2

(12) United States Patent
Liang et al.

(10) Patent No.: US 8,080,784 B2
(45) Date of Patent: Dec. 20, 2011

(54) IONIZATION DEVICE

(75) Inventors: Qiao Liang, Wuan (CN); Pengyuan Yang, Shangai (CN); Baohong Liu, Shanghai (CN); Niels Lion, Lausanne (CH); Christophe Roussel, Pontarlier (FR); Hubert Hugues Girault, Ropraz (CH)

(73) Assignee: Ecole Polytechnique Federale de Lausanne, Lausanne (CH)

( * ) Notice: Subject to any disclaimer, the term of this patent is extended or adjusted under 35 U.S.C. 154(b) by 129 days.

(21) Appl. No.: 12/522,572

(22) PCT Filed: Jan. 10, 2008

(86) PCT No.: PCT/EP2008/000140

§ 371 (c)(1),
(2), (4) Date: Nov. 10, 2009

(87) PCT Pub. No.: WO2008/083966

PCT Pub. Date: Jul. 17, 2008

(65) Prior Publication Data

US 2010/0090105 A1 Apr. 15, 2010

(30) Foreign Application Priority Data

Jan. 10, 2007 (GB) ..... 0700475.7

(51) Int. Cl.
*H01J 49/04* (2006.01)

(52) U.S. Cl. ..... 250/288; 250/281; 250/282; 250/284

(58) Field of Classification Search ..... 250/281, 250/282, 284, 288
See application file for complete search history.

(56) References Cited

U.S. PATENT DOCUMENTS

| | | | | |
|---|---|---|---|---|
| 6,225,047 | B1 * | 5/2001 | Hutchens et al. | 435/5 |
| 6,558,902 | B1 * | 5/2003 | Hillenkamp | 506/6 |
| 6,579,719 | B1 * | 6/2003 | Hutchens et al. | 506/9 |
| 6,811,969 | B1 * | 11/2004 | Hutchens et al. | 506/9 |
| 6,844,165 | B2 * | 1/2005 | Hutchens et al. | 435/7.92 |
| 6,881,586 | B2 * | 4/2005 | Hutchens et al. | 506/5 |
| 7,053,366 | B2 * | 5/2006 | Bouvier et al. | 250/288 |
| 7,413,909 | B2 * | 8/2008 | Hutchens et al. | 436/178 |
| 7,838,307 | B2 * | 11/2010 | Anderson et al. | 436/523 |
| 7,858,560 | B2 * | 12/2010 | Koster et al. | 506/13 |
| 2007/0218564 | A1 * | 9/2007 | Bachmann et al. | 436/174 |
| 2008/0054171 | A1 | 3/2008 | Bonn et al. | |
| 2009/0256069 | A1 * | 10/2009 | Hutchens et al. | 250/282 |
| 2011/0095201 | A1 * | 4/2011 | Stolowitz | 250/428 |

FOREIGN PATENT DOCUMENTS

WO 00/54309 A1 9/2000

* cited by examiner

*Primary Examiner* — David A Vanore
(74) *Attorney, Agent, or Firm* — Howson & Howson LLP

(57) ABSTRACT

A plate for matrix-assisted laser desorption ionization (MALDI) mass spectrometry comprising an electrically conductive substrate (1) covered with a light sensitive matrix (2), the matrix (2) comprising a light absorber, a charge carrier, a probe molecule and a photo-sensitizer (3) arranged to oxidize the probe molecule when irradiated with light (4).

14 Claims, 9 Drawing Sheets

IONIZATION DEVICE

BACKGROUND TO THE INVENTION

The present invention relates to a photo-reactive matrix for matrix-assisted laser desorption ionization (MALDI) mass spectrometry. This photo-reactive matrix allows the determination of the oxidation products of probe molecules and of the products of successive reactions involving the oxidation products of the probe molecules. For example, it provides a very efficient method to carry out photo-redox-induced tagging reactions on sample molecules during the MALDI ionization process.

MALDI ionization is a standard ionization technique to transfer globally neutral solid-state samples, in particular containing biomolecules, to gas-phase ions for further analysis by a mass spectrometer. MALDI ionization is such a general ionization technique that it has been applied to a wide range of biomolecules such as peptides and proteins, DNA [G. Corona and G. Toffoli, Comb. Chem. High Throughput Screen., 7 (2004) 707; C. Jurinke, P. Oeth and D. Van Den Boom, App. Biochem. Biotechnol. B, 26 (2004) 147; J. Ragoussis, G. P. Elvidge, K. Kaur and S. Colella, PLoS Genetics, 2 (2006) 0920], glycans and glycoconjugates [D. J. Harvey, Mass Spectrom. Rev., 18 (1999) 349; D. J. Harvey, Proteomics, 5 (2005) 1774; D. J. Harvey, Mass Spectrom. Rev., 25 (2006) 595], lipids [M. Pulfer and R. C. Murphy, Mass Spec. Rev., 22 (2003) 332; J. Schiller, J. Arnhold, S. Benard, M. Muller, S. Reichl and K. Arnold, Anal. Biochem., 267 (1999) 46] and coupled to various types of mass analyzers, such as ion traps (IT), time-of-flight (TOF), quadrupole-time-of-flight (Q-TOF), Fourier-transform Ion Cyclotron Resonance (FT-ICR).

The principle of MALDI ionization lies in the absorption of laser energy by an acidic crystalline matrix mixed with the sample to be analyzed. Upon energy absorption by the matrix, both matrix and analyte molecules are desorbed from the MALDI plate, and charge transfer reactions occur in the MALDI plume, which finally leads to gas-phase analyte ions that can be analyzed by the mass spectrometer [R. Knochenmuss, Analyst, 131 (2006) 966].

Several methods have been designed for MALDI plate preparation. First, different matrix chemicals can be used, such as α-cyano-4-hydroxycinnamic acid (CHCA), sinapic acid (SA), 2,5-dihydroxybenzoic acid (DHB) or 2-(4-hydroxyphenylazo)-benzoic acid (HABA). Second, different matrix deposition methods are available: the simple so-called dried-droplet technique, in which liquid matrix and sample are mixed, a drop of which is deposited on a metallic MALDI plate. Upon liquid evaporation the matrix co-crystallizes with the analyte. Alternatively, the overlayer method consists in depositing first a matrix layer on the MALDI plate, evaporate it, and then deposit a mixture of matrix and analyte over the first matrix layer. The overlayer method usually results in better spot reproducibility and potential flexibility about the choice of solvent used for the second layer crystallization. Several variations of these two methods have been introduced, but all suffer from the same caveats: the liquid evaporation that is necessary for matrix crystallization is poorly controlled and usually results in highly inhomogeneous spots. When the laser beam is focused on particular zones of the same spot, the probed microenvironments can be very different. Moreover, if the liquid sample/matrix mixtures are deposited directly on metallic plates that are usually hydrophilic, the liquid wets the surface and the droplet spills over a large area, which diminishes the final surface concentration of the matrix/analyte mixture.

Several alternative plates/matrices have been introduced over the recent years whether to alleviate the drawbacks listed above, or to add additional functions to the MALDI plates. In the first category, metallic plates covered with patterns of hydrophilic/hydrophobic zones have been proposed to help in confining matrix/analyte mixtures when deposited on the MALDI plate [H. Thomas, J. Havlis, J. Peychl and A. Shevchenko, Rapid Commun. Mass Spectrom., 18 (2004) 923; H. Wei, S. L. Dean, M. C. Parkin, K. Nolkrantz, J. P. O'Callaghan and R. T. Kennedy, J. Mass Spectrom., 40 (2005) 1338; T. Wenzel, K. Sparbier, T. Mieruch and M. Kostrzewa, Rapid Commun. Mass Spectrom., 20 (2006) 785; Y. C. Wu, C. H. Hsieh and M. F. Tam, Rapid. Commun. Mass Spectrom., 20 (2006) 309]; in the second category, plates covered with specific solid-phases presenting different affinities for targeted biomolecules: for example, Cyphergen has introduced polymer-coated MALDI plates that present different affinities for proteins, based on ion exchange and reverse-phase mechanisms. When the different surfaces are exposed to the sample, different proteins adsorb to different surfaces; non-retained proteins and co-solvents can be washed out [G. L. Wright, L. H. Cazares, S. M. Leung, S. Nasim, B. L. Adam, T. T. Yip, P. F. Schellhammer, L. Gong and A. Vlahou, Prost. Cancer Prost. Diseases, 2 (1999) 264]. Due to the intrinsic properties of the polymer matrices used, a MALDI laser can be directly shot on the polymeric surface, resulting in retained-analyte desorption and ionization. Alternatively, such MALDI plates can be derivatized with particular antibodies to capture specific proteins from complex samples, and further analyze them by mass spectrometry. This approach has been introduced by Cyphergen as well as Intrinsic Bioprobes [U. A. Kiernan, K. A. Tubbs, K. Gruber, D. Nedelkov, E. E. Niederkofler, P. Williams and R. W. Nelson, Anal. Biochem., 301 (2002) 49; D. Nedelkov and R. W. Nelson, Anal. Chim. Acta, 423 (2000) 1; R. W. Nelson, D. Nedelkov and K. A. Tubbs, Anal. Chem., 72 (2000) 404A].

SUMMARY OF THE INVENTION

The present invention relates to a plate for MALDI mass spectrometry according to claim 1 and a method for preparing the plate according to claim 15 or 16. Optional features of the invention are set out in the dependent claims. The matrices of the invention enable the structural determination of the oxidation products of a given probe molecule. These oxidation products can in term oxidize further other molecules and all the products of this electron transfer chain reaction can be studied by mass spectrometry. For example, the oxidized probe molecules can react by addition or substitution reactions on sample molecules, for example peptides, thereby generating mass tags on the sample molecules. These tagged sample molecules can then be analyzed by mass spectrometry.

BRIEF DESCRIPTION OF THE DRAWINGS

The invention will now be described by way of examples only, with reference to the accompanying drawings, in which.

DETAILED DESCRIPTION OF PARTICULAR EMBODIMENTS

Figure 1:
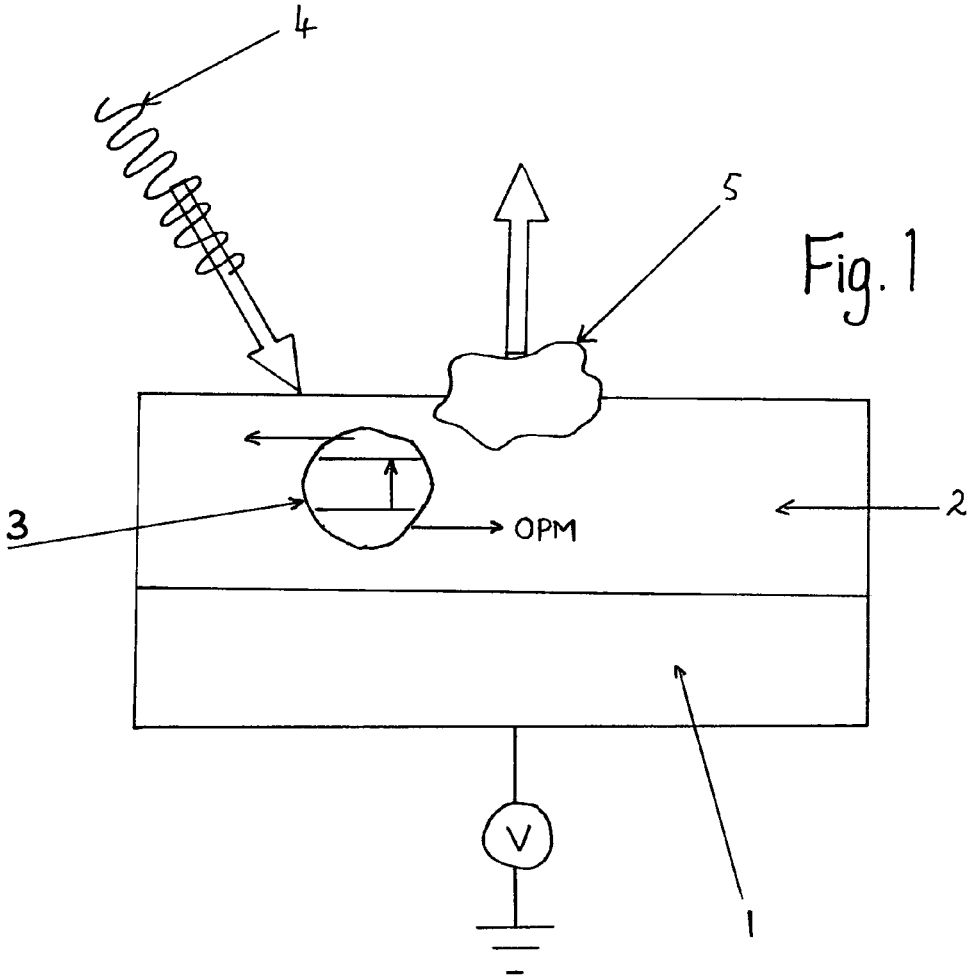
FIG. 1 schematically shows a photo-reactive MALDI plate according to the invention.

FIG. 1 shows a photo-reactive MALDI plate comprising a metallic substrate 1, a light sensitive photo-reactive matrix 2 containing a light absorber, a charge conductor, a photosensitizer 3 and a probe molecule PM. Upon irradiation by a UV laser 4, the probe molecule PM is oxidized to OPM and part of the matrix 5 is ablated and released in the gas phase. The ions released in the gas phase, including protonated OPMs, are driven by an electric field to a mass spectrometer (not shown). The structure of OPM can then be determined by classical mass spectrometry methods. In another aspect of the invention, OPM can further react with another sample molecule SM (shown in FIG. 4) either to oxidize it to OSM or to form a complex PM-SM and/or OPM-OSM thereby mass tagging SM by PM.

Substrate 1 in FIG. 1:

The substrate can be a commercially available MALDI plate or a homemade sample plate made of any conducting material. Typically, the sample plate is made of aluminum or stainless steel. It can present a flat, unmodified surface, or a surface with patterned spots or dots. Alternatively, the substrate can be made of a non-conductive material coated with a thin layer of conductive material such as one or more evaporated metals, or a semi-conductive material. When carrying out MALDI ionization in the positive mode, in most cases, a positive high voltage is applied to the sample plate with respect to the mass spectrometer. The electric field thereby generated between the MALDI plate and the mass spectrometer drives the ions released upon light absorption to the entrance of the mass spectrometer.

Light Sensitive Photo-Reactive Matrix 2:

The light sensitive photoreactive matrix 2 contains at least a photosensitizer 3, a light absorber and charge carrier and the respective probe molecules PM. The main difference between a classical MALDI matrix and the present invention is the presence and the function of the photosensitizer 3, and the presence and the function of the oxidizable probe molecule.

The matrix 2 can be a classical MALDI matrix containing usually a crystalline acid, such as α-cyano-4-hydroxycinnamic acid (CHCA), sinapic acid (SA), 2,5-dihydroxybenzoic acid (DHB) or 2-(4-hydroxy phenylazo)-benzoic acid (HABA). The acid plays the role of the light absorber generating the gas phase release of ions and that of charge conductor transporting the charges, usually protons, from the sample plate 1 through the matrix 2.

Figure 2:
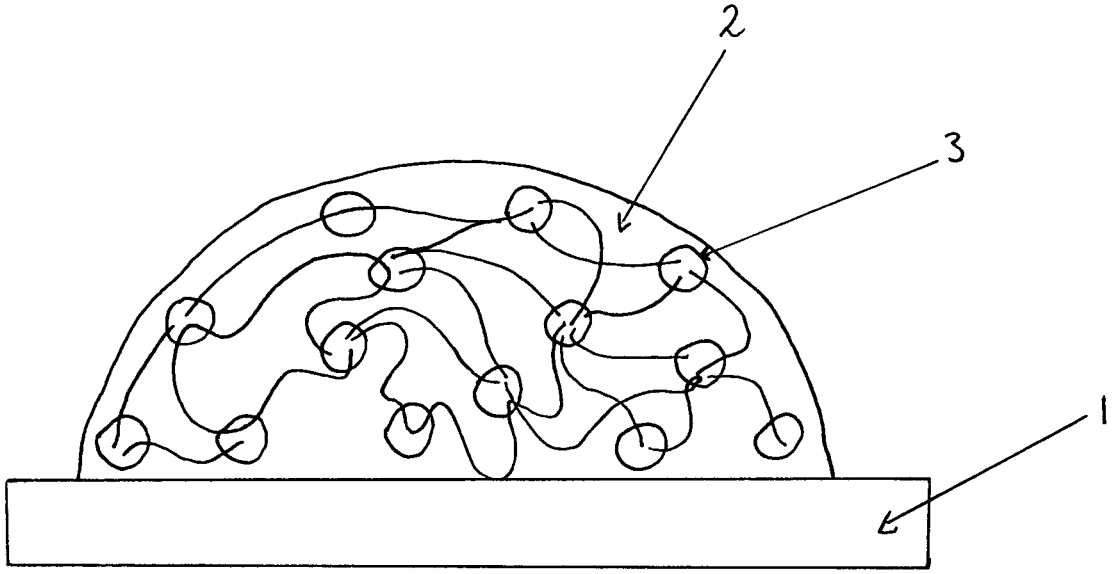
FIG. 2 shows a xerogel MALDI matrix spot made by a sol-gel process.

Alternatively, the MALDI matrix can be entrapped in a hybrid organic-inorganic matrix obtained by wet or solvent based sol-gel process. Alternatively, the MALDI matrix can be made of a hybrid organic-inorganic material but cured at high temperature to obtain a xerogel containing nanoparticles as shown in FIG. 2. FIG. 2 shows a xerogel MALDI matrix spot made by a sol-gel process and cured at high temperature to generate photosensitizer nanoparticles 3 covalently bonded to the matrix 2.

The photosensitizer 3 can be:

- a redox dye, i.e. a molecule absorbing light in the UV range corresponding to the wavelength of the light source 4, where the excited state of the molecule is redox active. These molecules include transition complexes or molecules including the following moieties: porphyrins, phtalocyanins;
- a nanoparticle such as a quantum dot e.g. CdSe, CdS, ZnO, absorbing light in the UV range corresponding to the wavelength of the light source 4, where the excited state of the nanoparticle is redox active;
- a semiconducting polymer absorbing light in the UV range corresponding to the wavelength of the light source 4, where the excited state of the polymer is redox active;
- a hybrid organic-inorganic structure made by a sol-gel process, for example a $TiO_2$ polymeric structure, that has been cured at high temperatures, to form a xerogel containing nanoparticles as shown in FIG. 2.

The charge carrier can be either an electron or proton conductor such as an acid usually also acting as the light absorber in the MALDI matrix.

The probe molecule PM is a redox active molecule that can be oxidized to OPM. Its redox standard potential is usually smaller than one volt versus a standard hydrogen electrode.

Photoionization Process.

Figure 4:
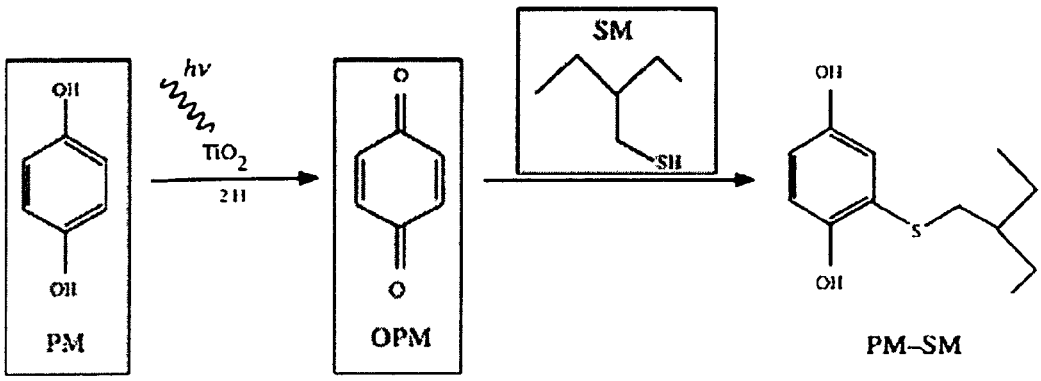
FIG. 4 shows the reaction mechanism for the oxidation of hydroquinone probe molecules in the presence of cysteinyl peptides.

Using a pulsed light source 4 such as a UV laser (here a Nd:YAG laser), the optical energy is absorbed by the light absorber in the matrix 2 thereby creating an ejection of ionized matter, the composition of which reflects that of the matrix. The gist of the present invention is to combine this photoionization process with a photochemical reaction between the light-excited photosensitizer 3 and the probe molecule PM in order to oxidize the latter to OPM. In this way, either the protonated form of OPM or the protonated form of the products of subsequent reactions can be determined in one step. FIG. 4 shows the reaction mechanism for the oxidation of the probe molecules PM (here hydroquinone) that react with the sample molecule SM (here a cysteine-containing peptide) to form the complex PM-SM.

Results

Figure 5:
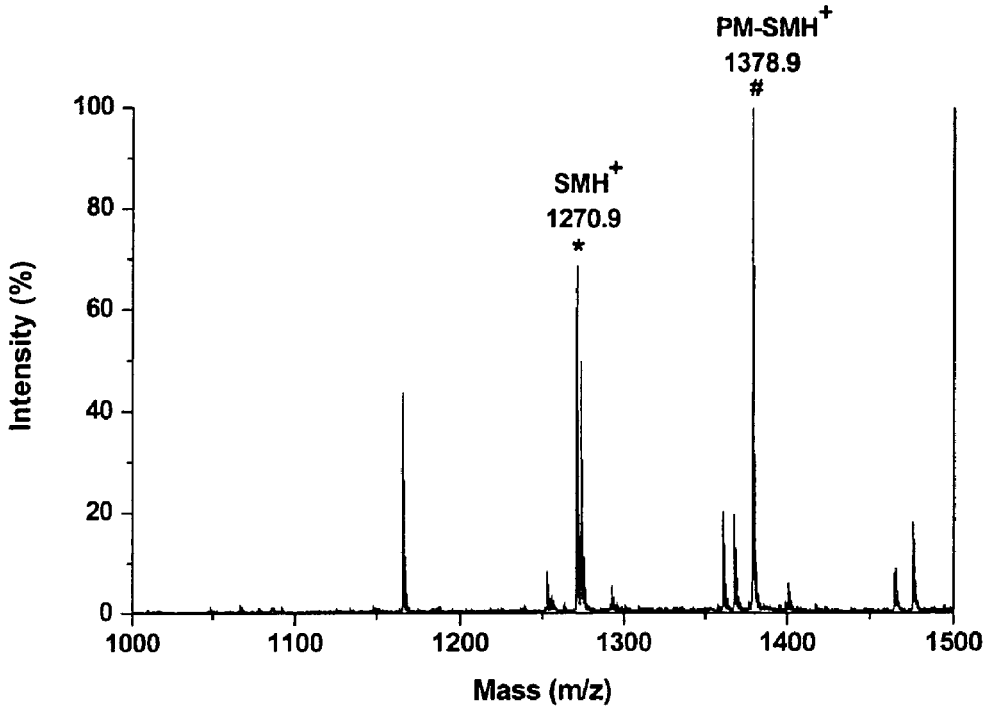
FIG. 5 shows the mass spectrum obtained with the photo-reactive matrix 2 illustrated in FIG. 1 for the reaction mechanism depicted in FIG. 4 (as described in details in Example 1)

FIG. 5 shows that the addition of commercially available $TiO_2$ nanoparticles to a classical CHCA MALDI matrix in the presence of citric acid enables the concomitant oxidation of the probe molecule PM, here hydroquinone, the oxidized form of which undergoes an addition reaction of the cysteine-containing peptide. The peak marked by a star (*) corresponds to the protonated form of the sample molecule SM (here a polypeptide SSDQFRPDDCT), i.e. $SMH^+$ and that marked by (#) corresponds to the protonated complex PM-$SMH^+$ where the hydroquinone is covalently attached to the cysteine residue. These data clearly show that the present invention permits the study of oxidized molecule and the products of the reaction of the oxidized probe molecule by mass spectrometry.

Figure 6:
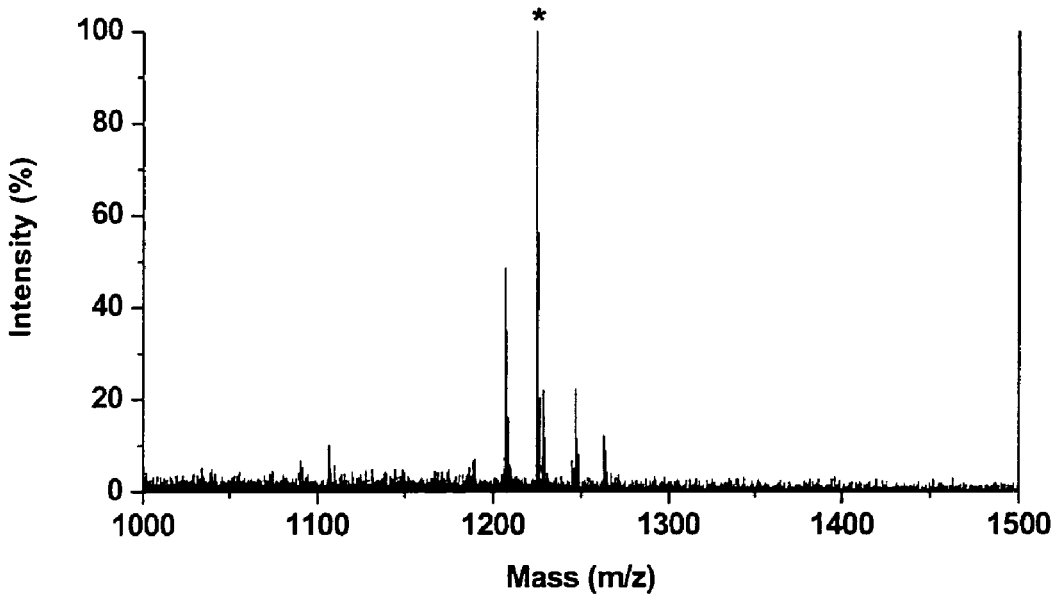
FIG. 6 shows the mass spectrum obtained with the photo-reactive matrix illustrated in FIG. 2 for the protonated form of a cysteine-free peptide.

FIG. 6 shows that the method described in FIG. 2 to synthesize a porous $TiO_2$ xerogel containing nanoparticles formed during the curing stage is a good method to fabricate a photo-reactive MALDI matrix. The data show the mass spectrum for the protonated form of a cysteine-free peptide (SSDQFRPDDGT) in the absence of oxidizable probe molecule PM, indicating that the sol-gel process can be used to fabricate a MALDI matrix. The peak marked by a star (*) corresponds to the protonated peptide.

Figure 7:
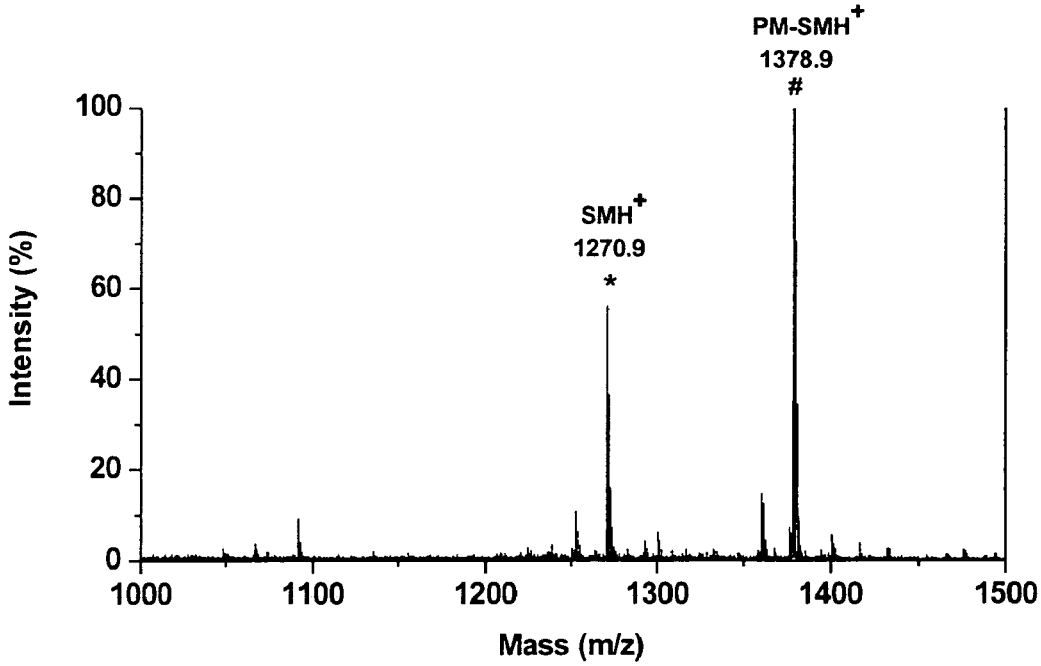
FIG. 7 shows the mass spectrum obtained with the photo-reactive matrix illustrated in FIG. 2 with the reaction mechanism depicted in FIG. 4 (as described in details in Example 2)

FIG. 7 shows that the method described in FIG. 2 to synthesize a porous $TiO_2$ xerogel containing nanoparticles formed during the curing stage is a good method to fabricate a photo-reactive MALDI matrix able to oxidize the probe molecule. The data show the mass spectrum of the protonated form of a cysteine containing peptide in the presence of the oxidizable probe molecule PM indicating that the sol-gel process can be used to fabricated photo-reactive MALDI matrix to study oxidation reactions and their subsequent chemical reactions, here the addition of hydroquinone to the cysteine-containing peptide. The peak marked by a star (*) corresponds to the protonated form of the sample molecule SM (here a polypeptide SSDQFRPDDCT), i.e. $SMH^+$ and that marked by (#) corresponds to the protonated complex $PM\text{-}SMH^+$ where the probe molecule, here hydroquinone, is attached to the cysteine residue.

Figure 8A:
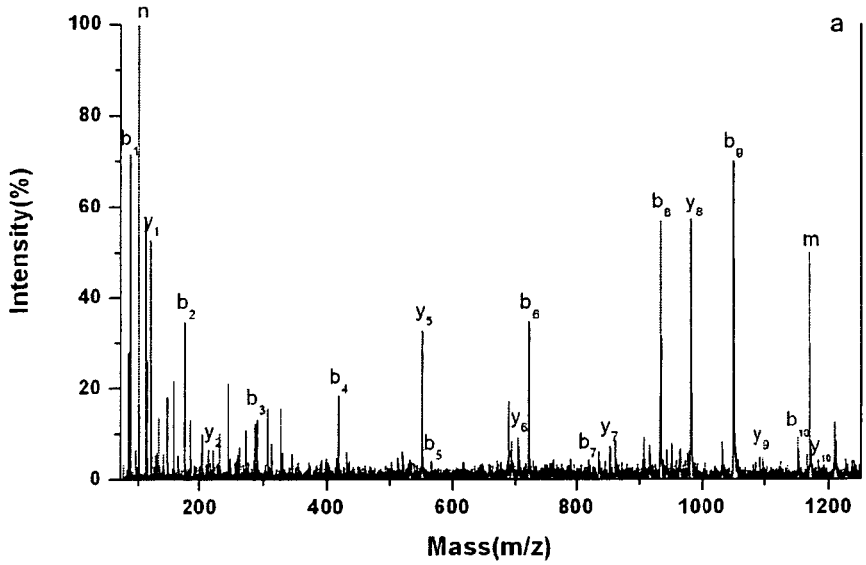
FIGS. 8*a* and 8*b* show the MS-MS spectra, i.e. the mass analysis of the fragments of the species detected in FIG. 7 from (a) the untagged peptide peak m/z 1270.9 Th (*) and (b) the tagged peptide peak m/z 1378.9 Th (#) respectively.
Figure 8B:
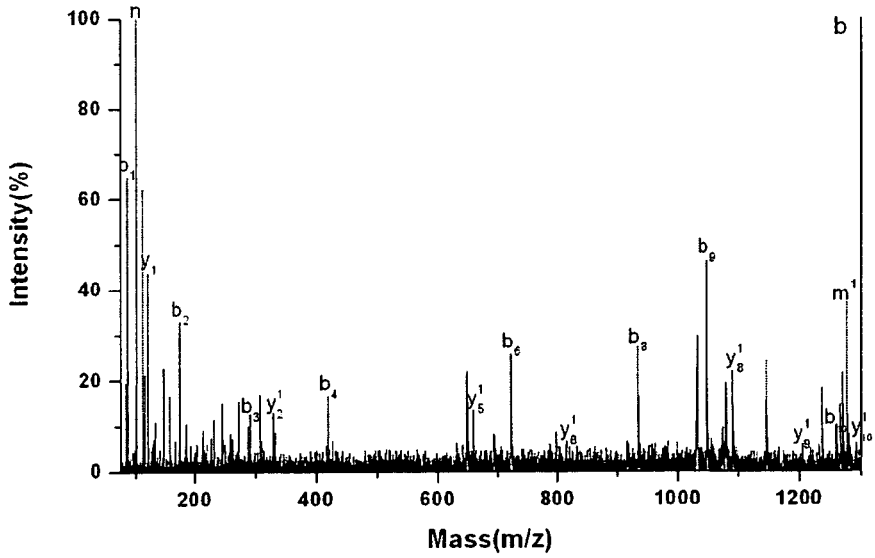
Figure 8B:
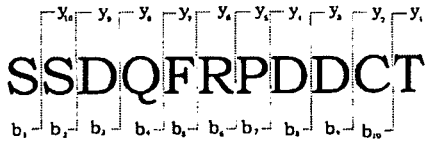

FIGS. 8*a* and 8*b* are MS-MS spectra that confirm that the complex $PM\text{-}SMH^+$ observed in FIG. 7 is indeed the cysteine-containing peptide tagged by hydroquinone on the cysteine moiety (fragments are named after the IUPAC nomenclature; fragments containing an superscript[1] in FIG. 8*b* contain the tagged cysteine residue).

Figure 9:
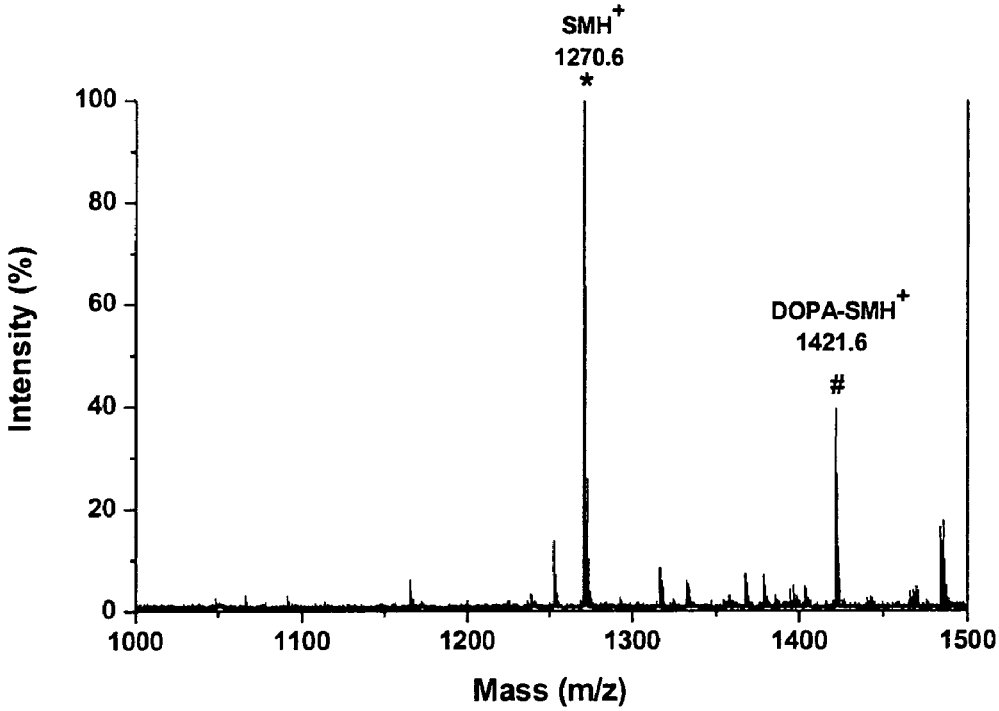
FIG. 9 shows the mass spectrum obtained with the photo-reactive matrix illustrated in FIG. 2 showing peaks for certain sample and probe molecules respectively.

FIG. 9 shows that the present method is not restricted to hydroquinone molecules but is applicable to any oxidizable molecules, here dopamine. The peak marked by a star (*) corresponds to the protonated form of the sample molecule SM, i.e. $SMH^+$, (here a polypeptide SSDQFRPDDCT) and that marked by (#) corresponds to the protonated complex $DOPA\text{-}SMH^+$ where the probe molecule dopamine is attached to the cysteine residue.

Advantages of the Present Method

To study the oxidation product of a probe molecule by mass spectrometry, one usually operates in a two-step approach. First, we oxidize the probe molecule either chemically using strong oxidants or electrochemically on an anode or even photo-chemically. The oxidized products are placed in a second step in a classical MALDI matrix for mass spectrometry analysis. Here with the present invention, we can operate in a single step mode by placing directly the probe molecule in the MALDI matrix together with the photo-sensitizer 3, and the oxidation reaction occurs photo-electrochemically in the MALDI matrix 2 upon light irradiation. This photo-electro-reactive ionization MALDI matrix can then be used for high-throughput screening and evaluation of anti-oxidants and drugs. It also facilitates the study of metabolic pathway in biological processes.

EXAMPLE 1

MALDI Matrix Containing $TiO_2$ Nanoparticles

A classical MALDI matrix is prepared by adding commercially available titanium oxide nanoparticles (Degussa P25, 21 nm in diameter, 50 $m^2/g$). To break the aggregates into separate particles, the powder was ground in a porcelain mortar with a small amount of water and finally suspended in water and ethanol mixture (10 mg per 100 mL), and then deposited as a thin layer or an array of spots on a stainless steel plate and dried at room atmosphere. $TiO_2$ nanoparticles are efficient catalyst for the photo-oxidation of organic molecules in aqueous solutions and are used here to oxidize the probe molecule PM to generate directly OPM that can further react with other sample molecules SM. The results obtained by this approach using the reaction scheme described in FIG. 4 are shown in FIG. 5.

EXAMPLE 2

MALDI Matrix Prepared by a Sol-Gel Process

A $TiO_2$ matrix has been obtained from the hydrolysis-condensation of $Ti(OBu)_4$ [J. Blanchard, S. Barbouxdoeuff, J. Maquet and C. Sanchez, New J. Chem., 19 (1995) 929]. In contrast with classical methods [J. Blanchard, S. Barbouxdoeuff, J. Maquet and C. Sanchez, New J. Chem., 19 (1995) 929; C. T. Chen and Y. C. Chen, Rapid Commun. Mass Spectrom., 18 (2004) 1956] (i.e. hydrolysis-condensation performed in alcohol), the Sol-Gel process is carried out in aqueous medium [H. Wu, Y. Tian, B. Liu, H. Lu, X. Wang, J. Zhai, H. Jin, P. Yang, Y. Xu and H. Wang, J. Proteome Res., 3 (2004) 1201; T. Zhang, B. Tian, J. Kong, P. Yang and B. Liu, Anal. Chim. Acta, 489 (2003) 199] using polyethyleneglycol (PEG) as stabilizing and porogenic agent [C. T. Chen and Y. C. Chen, Rapid Commun. Mass Spectrom., 18 (2004) 1956]. The resulting $TiO_2$ Sol is then deposited (~2 μL) as a thin layer or an array of spots on a flat stainless steel plate and dried at room atmosphere and temperature overnight. The $TiO_2$-modified plate can subsequently be heated at 400° C. for one hour and naturally cooled-down to room temperature and stored in desiccators.

Figure 3:
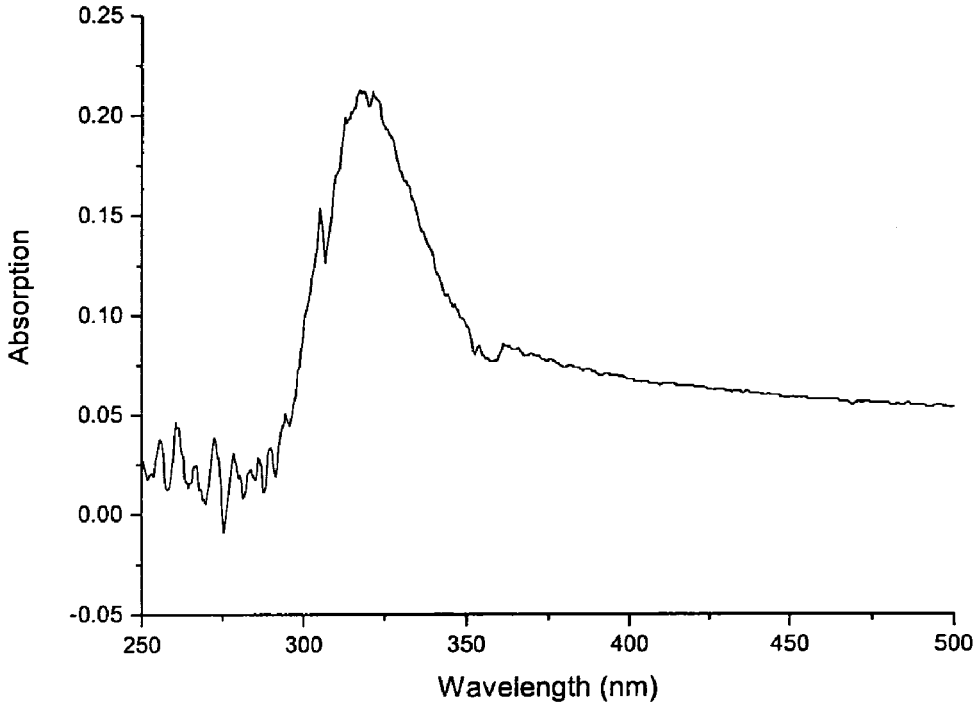
FIG. 3 shows the UV spectrum of the photo-reactive xerogel MALDI matrix.

The X-ray diffraction (XRD) pattern of the $TiO_2$ matrix (data not shown) displays the characteristics of an amorphous phase partially made of anatase [R. Campostrini, G. Carturan, L. Palmisano, M. Schiavello and A. Sclafani, Mat. Chem. Phys., 38 (1994) 277], which confers photo-electro-reactivity to it [A. Sclafani and J. M. Herrmann, J. Phys. Chem., 100 (1996) 13655]. The UV-visible spectrum of the resulting $TiO_2$ matrix (FIG. 3) shows an absorption peak around 320 nm, compatible with Nd:YAG lasers (355 nm) used in many MALDI sources.

To complete the preparation of the MALDI matrix, a redox probe (such as hydroquinone) is added to the xerogel deposited on the sample plate. Afterwards, the acid buffer such as citric acid is added as a proton donor. After solvent evaporation, the sample plate is analyzed by MALDI-TOF mass spectrometry.

To show that this method to prepare a MALDI matrix is suitable for mass spectrometry analysis, we have carried out a measurement without including the redox probe molecule, just adding a sample molecule, here cysteine-free peptide (SSDQFRPDDGT). The data obtained are shown in FIG. 6, and only the peak for the protonated peptide can be observed. This result clearly shows that the sol-gel method for the preparation of a MALDI matrix yields very good mass spectrometry results.

As can be seen in FIG. 7, using SSDQFRPDDCT as model peptide with a cysteine unit, the resulting mass spectra exhibit a peak (*) for the sample molecule SM, i.e. $SMH^+$ corresponds to the protonated form of the untagged peptide, and a peak (#) for the singly tagged peptide (the protonated complex $PM\text{-}SMH^+$), the mass difference between the two peaks corresponding exactly to the mass of the benzoquinone tag. The MS/MS spectrum clearly shows that the benzoquinone has been linked on cysteine residue of the peptide as shown in FIG. 8*b*.

Another example of redox probe molecule is Dopamine. As can be seen in FIG. 9, using SSDQFRPDDCT as model peptide with a cysteine unit, the resulting mass spectrum exhibits the peak of the untagged peptide (*), i.e. $SMH^+$, and the peak of the tagged peptide (#) i.e. the complex $PM\text{-}SMH^+$.

As a consequence of the tagging process, which has been shown to be specific to cysteine residues [C. Roussel, T. C. Rohner, H. Jensen and H. H. Girault, ChemPhysChem, 4 (2003) 200; T. C. Rohner, J. S. Rossier and H. H. Girault, Electrochem. Commun., 4 (2002) 695], it is possible to count the number of cysteines present in a given peptide from the single MS spectrum. This information has been shown to be of great value in the process of database interrogation for protein identification [L. Dayon, C. Roussel, M. Prudent, N. Lion and H. H. Girault, Electrophoresis, 26 (2005) 238].

The invention claimed is:

1. A plate for matrix-assisted laser desorption ionization (MALDI) mass spectrometry comprising an electrically conductive substrate covered with a light sensitive matrix, the matrix comprising a light absorber, a charge carrier, a probe molecule and a photo-sensitizer arranged to oxidise the probe molecule when irradiated with light.

2. A plate according to claim 1 wherein the light absorber and charge carrier comprises a crystalline acid.

3. A plate according to claim 1 wherein the light sensitive matrix comprises a hybrid organic-inorganic gel.

4. A plate according to claim 1 wherein the light sensitive matrix comprises a xerogel containing semi-conducting nanoparticles.

5. A plate according to claim 1 wherein the photo-sensitizer comprises semi-conducting nanoparticles that absorb light at a wavelength substantially equal to that used for matrix-assisted laser desorption ionization.

6. A plate according to claim 5 where the semi-conducting nanoparticles comprise titanium dioxide, zinc oxide or cadmium selenide.

7. A plate according to claim 1, wherein the photo-sensitizer comprises redox dyes that absorb light at a wavelength substantially equal to that used for matrix-assisted laser desorption ionization.

8. A plate according to claim 7 where the redox dyes includes transition metal complexes or molecules including moieties such as porphyrin or phthalocyanin moieties.

9. A plate according to claim 1, wherein the thickness of the light sensitive matrix ranges from 50 manometers to 50 micrometers.

10. A plate according to claim 1, where the probe molecule can be oxidised to further react by oxidation, addition, elimination or substitution with sample molecules.

11. A plate according to claim 1, wherein the light sensitive matrix is deposited on the substrate as an array of individual spots.

12. A plate according to claim 11 wherein each spot has a surface area ranging from 25 square micrometers to 25 square millimeters.

13. A plate according to claim 11 wherein the spots have a circular, triangular, rectangular or square shape.

14. A plate according to claim 1, wherein the electrically conductive substrate comprises stainless steel, aluminum, zinc, copper, silicon or a conductive/semi-conductive polymer.

* * * * *